US006851414B2

(12) United States Patent
Gao et al.

(10) Patent No.: US 6,851,414 B2
(45) Date of Patent: Feb. 8, 2005

(54) METHOD AND SYSTEM TO EXTEND LUBRICANT LIFE IN INTERNAL COMBUSTION EGR SYSTEMS

(75) Inventors: Jason Zhisheng Gao, Rose Valley, PA (US); Mahmoud Mostafa Hafez, Philadelphia, PA (US); Riccardo Conti, Marlton, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/620,059

(22) Filed: Jul. 15, 2003

(65) Prior Publication Data

US 2004/0050373 A1 Mar. 18, 2004

Related U.S. Application Data

(60) Provisional application No. 60/399,523, filed on Jul. 30, 2002.

(51) Int. Cl.[7] ..... F02M 25/07
(52) U.S. Cl. ..... 123/568.12; 123/568.11
(58) Field of Search ..... 123/568.12, 568.11; 60/278, 297, 299, 302

(56) References Cited

U.S. PATENT DOCUMENTS 3,739,583 A * 6/1973 Tourtellotte et al. ..... 60/274
4,356,806 A * 11/1982 Freesh ..... 123/568.12
6,379,564 B1 * 4/2002 Rohrbach et al. ..... 210/765

FOREIGN PATENT DOCUMENTS

WO WO 02/22239 A1 * 3/2002
WO WO02/22239 A1 3/2002 ..... B01D/53/92

* cited by examiner

*Primary Examiner*—Mahmoud Gimie
*Assistant Examiner*—Arnold Castro
(74) *Attorney, Agent, or Firm*—Norby L. Foss; Joseph J. Allocca

(57) ABSTRACT

A device and method to extend the useful lubricant life in a diesel engine equipped with an Exhaust Gas Recirculation (EGR) system consisting of placing a chemical filter in an area of relatively higher humidity either in the EGR stream or near the intake manifold. In some cases, placing chemical filters in both locations would be preferred. This device may also be used in combination with a chemical filter placed in the lubricant recirculation system which produces a synergistic effect beyond the individual effects of either component.

15 Claims, 3 Drawing Sheets

METHOD AND SYSTEM TO EXTEND LUBRICANT LIFE IN INTERNAL COMBUSTION EGR SYSTEMS

Figure 1:
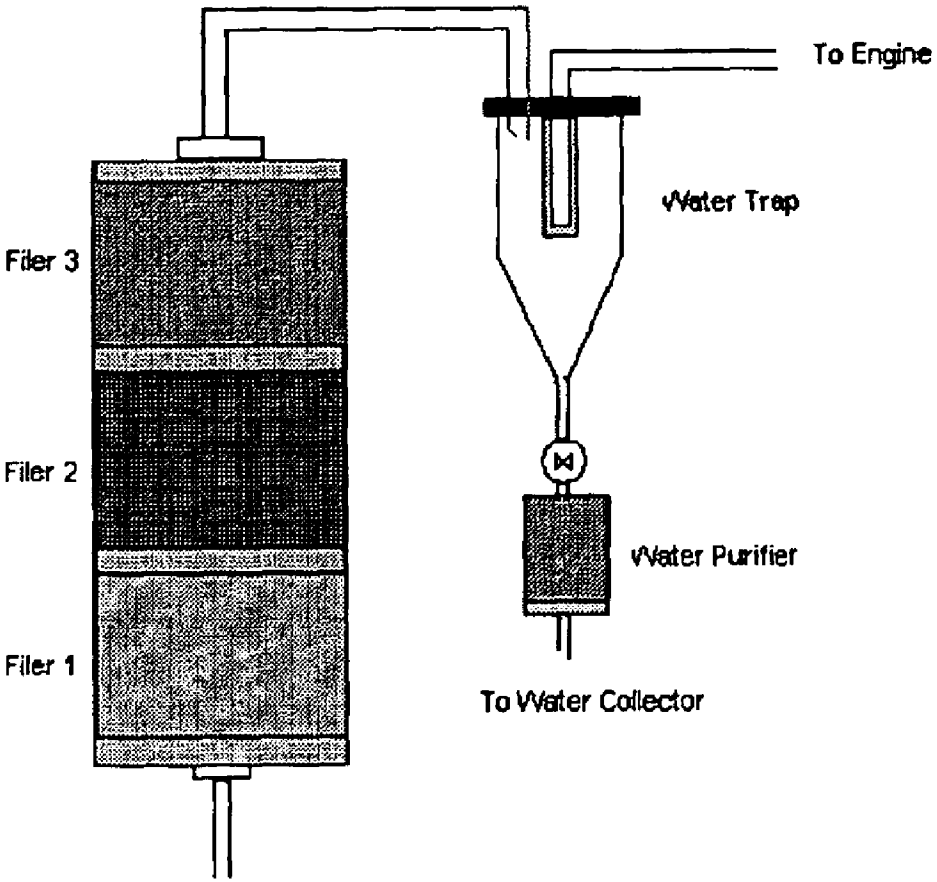

This application claims the benefit of U.S. Provisional Application 60/399,523 filed Jul. 30, 2002.

FIELD OF THE INVENTION

The present invention relates to a method and system to extend the lubricant life in an internal combustion engine equipped with exhaust gas recirculation (EGR).

BACKGROUND OF THE INVENTION

Internal combustion engines have been employed for over a century. However, with the continuing high cost of fuel and quest to reduce emissions, manufacturers have developed many methods to make the combustion process more efficient and, at the same time, with lower emissions. One of these methods is known as Exhaust Gas Recirculation (EGR). U.S. Pat. No. 3,872,845 describes an early EGR system as applied to a passenger vehicle. EGR has been shown extremely effective for removing $NO_x$ from internal combustion emissions.

EGR systems are also being employed in heavy duty diesel engines as pending environmental regulations are requiring significant reduction in $NO_x$ emissions. U.S. Pat. No. 4,055,158 teaches that an effective way to improve the EGR effectiveness in reducing $NO_x$ emission is to cool the recirculated exhaust before it is fed into the intake system. By cooling the exhaust from 400–800° F. to 150–250° F., the $NO_x$ emissions were reduced by an additional 10%. As an added advantage, cooling the EGR also allows lower charge air temperature (thus a higher air to fuel ratio) which is also critical to the efficiency of modem heavy diesel engines equipped with turbo charger and intercooler.

One problem associated with cooling the recirculated exhaust gasses is that the entrained moisture is likely to condense. Indeed, approximately 0.5 to 4% of the intake air is actually water vapor. In the exhaust gas, the water content is even higher due to the fact that water is one of the combustion byproducts. U.S. Pat. No. 4,055,158 teaches that a condensate trap should be situated downstream of the heat-exchange device. U.S. Pat. No. 6,367,256B1 further teaches that the condensate from the EGR stream is acidic in nature and causes engine component degradation. The '256 patent teaches that a series of condensate traps should be employed, the condensate later being reheated and discharged to the tailpipe as gasses. This solution reduces the environmental friendliness of the EGR system is by introducing gaseous acids to the air. At the same time it cannot remove the condensate formed after the traps, such as those in the intake manifold.

Another possible way to reduce the acidic gasses from the EGR stream is to remove $NO_x$ and $SO_x$ in the exhaust gas before recirculating to the engine intake. The techniques of using absorbents such as charcoal, calcium carbonate, and calcium hydroxide to remove harmful species such as carbon monoxide from the exhaust gas were developed many decades ago, as disclosed in U.S. Pat. Nos. 2,077,563 and 2,216,763. However, these techniques, without further refinements, have now been found to be less effective in general exhaust gas treatment compared to the modern catalysis/absorption techniques. U.S. Pat. No. 3,739,583 discloses the use of a catalyst bed in the exhaust stream to reduce the $NO_x$ level. The use of catalytic absorber to remove $NO_x$, $SO_x$, and CO in the exhaust gas has also been disclosed earlier in U.S. Pat. No. 5,451,558. In these catalytic absorber systems, the catalysts and absorbers are either fabricated together or located in proximity. The catalysts oxidize the NO, $SO_2$ and CO to $NO_2$, $SO_3$, and $CO_2$, respectively, so that they can be readily absorbed by the absorbers.

Although treating the entire exhaust gas is desirable for emission control, removing the acidic gases in the EGR stream is more critical to engine protection. A recent application WO 02/22239A1 teaches the use of a combined catalytic/sorber system that first oxidizes $SO_2$ to $SO_3$ and then removes the $SO_3$ through an absorption process in an EGR stream.

The use of catalyst to remove $NO_x$ and $SO_x$ has been an important area of investigation in the last few years due to the future environmental regulations such as Euro IV and EPA 2007 emission standards. However, the technology for heavy duty diesel engines has not matured due to a number of issues around catalyst life such as $SO_x$ poisoning etc. In addition, most of the catalyst/sorber systems are based on a honeycomb structure and the diffusion rates of the $NO_x$ and $SO_x$ are critical to absorption efficiency.

One problem with the catalyst/sober systems is that they are highly sensitive to temperature. Indeed, EP 0597106B teaches that the sorber portion is not effective below 200° C. for the removal of $NO_x$. Similarly, WO0222239A1 teaches that the sorber is far less effective below 400° C. for the removal of $SO_x$. Another problem with a catalyst/sorber system is the significant heat generation of the system itself. Since diesel engines are more efficient with lower EGR stream temperature, the catalyst/sorber system process is inefficient because it adds heat to the EGR stream that must be removed.

Taking a different approach, GB2301865 teaches the use of an aqueous ammonia solution to treat carbon dioxide in an EGR stream. This technique is not suitable for heavy duty trucks since it requires the handling and recurring replenishment of large quantities of volatile ammonia and water.

The use of EGR has significant impact on the useful life of the engine lubricant because of the acids formed in the oil as oxidation products as well as the acidic nature of the blow-by gas, lubricating oils are formulated to be basic in nature. Indeed, "overbased" detergents are usually used to give the lubricant the capability to act as a neutralization agent. However, a recurring problem in EGR diesel engines is that the useful life of the lubricating oil is significantly reduced. Specifically, the basicity of the lubricating oil is rapidly depleted in this environment.

SUMMARY OF THE INVENTION

One of the objectives of the present invention is to extend the lubricant life in EGR equipped diesel engines by ensuring that the entrained acidic components in the EGR stream are removed before allowing them to re-enter the combustion chamber. In this manner, the basicity of the lubricant will not be adversely affected. More specifically, the current invention employs a combination of a heat exchanger/cooler and a chemical filter/trap in the EGR stream to remove the acidic components effectively. A similar chemical filter can also be placed after the EGR stream is mixed with the intake air but before the air is charged into the engine. In addition, a chemical filter may also be placed in the lubricant to remove the acidic components and metal ions in the lubricant and to supplement the basicity. These three filters may be used independently or simultaneously to maximize the oil life.

DETAILED DESCRIPTION

The increased performance demands of modern diesel engines have resulted in their mounting sophistication, complexity and sensitivity. In response, engine oils have also become more advanced by utilizing more complex base stocks and additives. One particular advancement in lubricant technology, has been to "overbase" the detergent in the lubricant. This provides a basic "reserve" to neutralize the acids generated due to oxidation in the oil as well as the acids introduced from blow-by gas. The basic "reserve" of a lubricant is known as the total base number (TBN). Typically, an engine oil has a TBN of 8–12. TBN higher than the typical range could lead to higher piston deposit. At the same time, higher detergent content can also hinder the action of antiwear agents and dispersants.

Diesel lubricants are designed to remove a known and expected amount of acidic by-products over the useful life of the oil. However, with the introduction of EGR in diesel engines, the useful life of diesel lubricants is expected to be reduced dramatically. It was reported in SAE paper 1999-01-3574 that EGR increases soot accumulation, lubricant oxidation, and additive depletion under high load condition (T. W. Ryan III, et al, "Effects of Exhaust Gas Recirculation on the Degradation Rates of Lubricating Oil in a Heavy-Duty Diesel Engine"). A new engine oil category, known as API CI-4, was defined in December of 2001 to address the needs of cooled EGR engines. In the API CI-4 specifications, two EGR engine tests, M11 EGR and Mack T-10, were developed for qualifying API CI-4 engine oils. The API CI-4 category was described in SAE paper 2002-01-1673 (J. A. McGeehan, et al. "API CI-4: The First Oil Category for Diesel Engines Using Cooled Exhaust Gas Recirculation").

Even though a new diesel engine oil category was developed, early testing indicates that lubricant life is significantly shortened in cooled EGR engines. It is theorized that the required cooling of the recirculated exhaust gasses entrain the gaseous acids as water vapor condenses and seep through the combustion chamber to reach the engine lubricant. The addition of the acidic condensate to the oil would have significant impact on the oil life.

The current invention extends the useful lubricant life in an EGR equipped diesel engine by using a combination of a heat exchanger (cooler) and a chemical filter in the EGR stream to remove the acidic components before they are introduced into the intake manifold. The EGR cooler is adjusted so that the humidity of the EGR stream is higher to promote the absorption of the gaseous acids, the exhaust gases being cooled in the EGR cooler to temperatures such that the relative humidity of the exhaust gas is greater than about 20%, preferably greater than about 50%. The absorbents used include metal carbonates (e.g., calcium or magnesium carbonates), metal oxides (e.g., zinc oxide and Alumina), silica, metal hydroxides (e.g., calcium or sodium hydroxides), activated carbon, synthetic polymer resins (e.g.. ion-exchange resins), and other natural absorbents such as limestone and various clays, as well as their mixtures. A single or multiple layers of the absorbents can be used in the filter.

Metal carbonates, including sodium carbonate ($Na_2CO_3$), potassium carbonate ($K_2CO_3$), magnesium carbonate ($MgCO_3$), calcium carbonate ($CaCO_3$), as well as other carbonate salts of organic bases and ammonia, can effectively absorb and neutralize the acidic components in the exhaust stream at a certain relative humidity. The metal carbonates that are insoluble in water, but become soluble after converted to nitrates, nitriles, or sulfates, would be particularly useful since the reacted layers (inactive) can be washed away when the exhaust gas reaches its dew-point during contact with the absorbent. Similarly, metal oxides, specially zinc oxide, magnesium oxide, and aluminum oxide (Alumina), and metal hydroxides such as calcium hydroxide, magnesium hydroxide, and sodium hydroxides can also remove the acidic components effectively.

In additional to the inorganic compounds mentioned above, activated carbons, particularly the impregnated carbons, are also very effective in removing the acidic components in the exhaust gas at a certain relative humidity. The activated carbon can be prepared from either coconut shell, coal, wood, or other raw material. Activated carbon fibers can also be used.

Ion-exchange resins are another family of absorbents that can be used in this application. To effectively neutralize the acidic components, strong or weak base resins can be incorporated into the filter. Typical ion-exchange resins are based on styrene-divinylbezene copolymers. Ion-exchange resins in the hydroxide form are of special interest since these resins will release water only when reacted with acids. A typical ion-exchange resin for this application is Lewatit Monoplus M500 OH (Sybron Chemicals, Inc.).

Some anionic clay composite materials, as disclosed in U.S. Pat. Nos. 5,583,082 and 5,785,938 for removal of $SO_x$ from flue gas streams and reference therein, should be also suitable for the present application. The $SO_x$ content in the flue gas stream is much higher than that in the diesel exhaust stream. However, the low temperature and high humidity environment of the present invention would be more favorable for the absorption process.

The chemical filter for the air phase is illustrated as FIG. 1. The filter consists of one or more layers of filters which may be the same or different. The layers are separated by synthetic or cellulose membranes. As a non-limiting example, filter #1 might be calcium carbonate, while filter #2 might be zinc oxide, and filter #3 might be activated carbon. Although not a necessity, another non-limiting example might include a water trap to prevent the condensate from contacting other engine parts. In another non-limiting example, a replaceable water purifier may be used to remove the harmful components. A typical water purifier would contain activated carbon.

In contrast to the catalyst/sorber systems taught in WO0222239A1 and U.S. Pat. No. 5,451,558 which target the entire range of $NO_x$, CO, and $SO_2$, the chemical filter of the present invention selectively remove the acidic components in the exhaust system. The gaseous components which are less likely to condensate out as acids, such as NO (which is 90% of $NO_x$) are less affected by the chemical filter of the present invention than the above discussed catalyst/sorber systems. The chemical filter is especially effective in a (relatively) low temperature, high humidity environment in which the catalyst/absorber systems admit to being far less effective.

While the present invention is not limited by any theory discussed herein, the inventors propose two mechanisms to explain the unexpected efficiency of chemical filters placed in an EGR stream with a relatively high humidity, low temperature environment. One proposed mechanism is that gas phase water droplets are formed trapping acid-producing gaseous precursors, including $SO_3$ and $NO_2$. When these now acidic water droplets, come in contact with a base in the chemical filter, they are quickly neutralized. Similarly, the second mechanism proposes that the bases in the in the chemical filter become coated with water as it approaches its dew-point, creating a basic solution that dissolves and neutralizes the gaseous acidic precursors. Both theories propose that the present invention does not completely depend on the high-temperature gas/solid phase diffusion mechanism of the catalyst/sober systems, instead replacing it with a much quicker and effective liquid/gas phase acid-base reaction. The active surface of the filters may also be refreshed if the salts formed are water-soluble. The chemical filter can be replaced or recharged, without the issues related to catalyst regeneration and poisoning.

Figure 2:
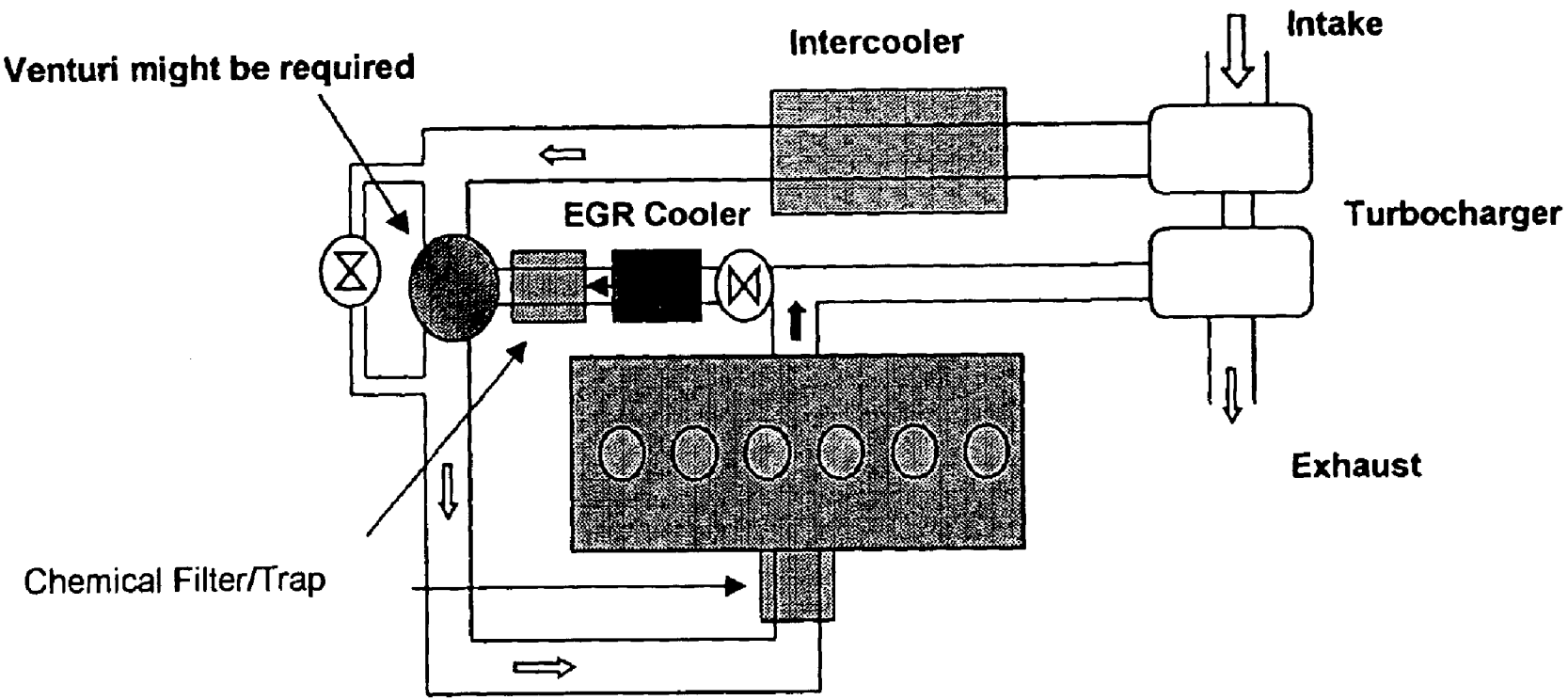

The chemical filter may be placed in any location, preferably where the EGR stream temperatures may be controlled to be near the dew-point. The chemical filter efficiency increases with the maximization of the exhaust gas/water neutralization reaction. Thus locations of high humidity are preferred. Consequently, it is desirable that the exhaust gases be cooled in the EGR cooler to temperatures such that the relative humidity of the exhaust gas is greater than about 20%, preferably greater than about 50%. Indeed, it is theorized that the optimal placement of the filters will be in a location where the EGR stream temperature is only slightly above its dew-point. Non-limiting examples of filter locations are illustrated in FIG. 2. The first location is after the EGR cooler. The 2nd location is before the intake manifold after the EGR stream is merged with the intake air. While either location may be sufficient, both locations are suggested as the water content will vary not only clue to the combustion process, but also the entrained humidity in the intake air. Similarly, the temperature will not only be affected by the EGR cooler, but also by the temperature of the intake air. Thus, filters should be considered for both locations.

Figure 3:
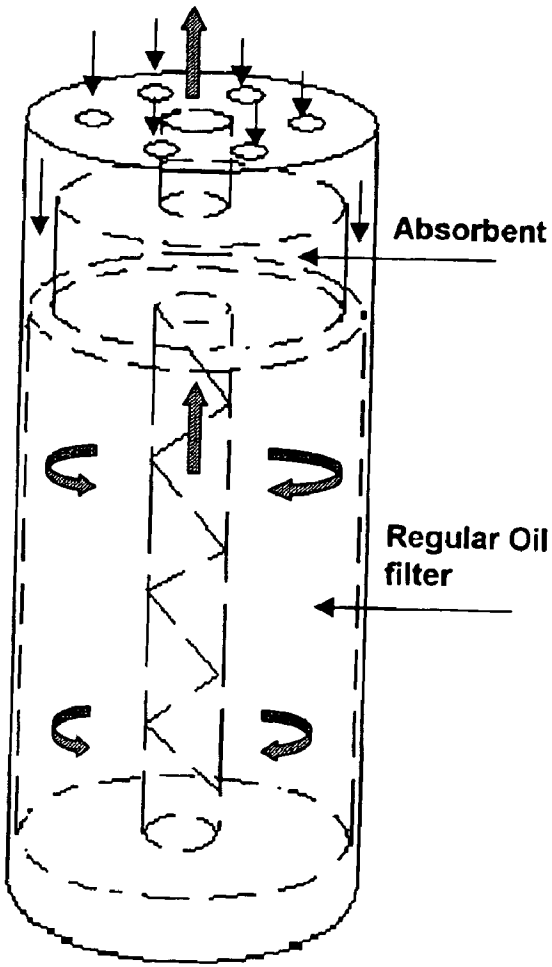

Although the present invention's placement of a chemical filter in a humid environment in the EGR gas stream will significantly increase lubricant life by itself, the inventors have discovered that the present invention, used in combination with chemical filters placed in the lubrication recirculation system, synergistically enhances lubricant life unexpectedly greater than that from either single component. A typical oil filter with acid neutralizing absorbent is shown in FIG. 3.

The acids that reach the piston ring zone will come into contact with the lubricant. As disclosed in U.S. Pat. No. 5,478,463 and other references therein, oil filters in the downstream of the piston ring zone can be used to neutralize the acids. In the piston ring zone area, the acids will first react with the weak bases in the oil such as the dispersants to form salts. The neutral salts are then contacted with a heterogeneous strong base. The strong base will displace the weak base for the acid and release the weak base for further neutralization of acids. The heterogeneous base should be located subsequent to or downstream of the piston ring zone strong and preferably be part of the oil filter system.

A most commonly used dispersant in engine oils is polyethyleneamine amide of polybutenylsuccinic anhydride. The dispersant is used not only as an "proton carrier" by also to disperse soot and sludge in the engine. The typical dispersant concentration in an API CI-4 engine oil is between 6–10 wt %. Higher dispersant treat might have negative impact on seal compatibility and wear protection of the lubricant. If the amount of acids in contact with the lubricant were high, the amount of dispersant available as "proton carrier" would be insufficient. It is thus expected that the method of using heterogeneous base in the oil filter will not be sufficient to treat high concentration of acids and the oil will reach its maximum useful life in a very short timeframe.

While not limiting the present invention in any way, it is theorized that there is a strong synergy between the EGR filter in the present invention and the heterogeneous base in the oil filter since if the concentration of the acids reached the oil is lower than the concentration of the dispersant at a given time, the heterogeneous base in the oil filter can be effective in removing the proton from the dispersant and return the dispersant in its original form. This cycle enables a much longer dipsersant life and oil life.

EXAMPLE 1

A Mack T-10 engine was modified to conduct the experiments. First, a side stream was taken from the EGR stream in the engine to collect condensate. The side stream was taken after the EGR cooler. A filter made of a stainless steel housing, filled with two layers of reagent grade $CaCO_3$ from Aldrich (separated by cellulose fibers), was installed in the side stream. The chemical filter was followed by a Balston air filter to remove all the particles with >0.5 micron in size. In order to collect the condensate, a heat exchanger (chiller) was placed after the chemical filter to cool the side stream further. A codensate trap was used to collected the condensate. The pH values of the condensates collected are given in Table 1.

| | PH |
|---|---|
| Without Filter | 1.6 |
| With Filter, Collection #1 (first 10 hrs.) | 2.5 |
| With Filter, Collection #2 (2nd 10 hrs.) | 5.4 |

EXAMPLE 2

The same device as Example 1 was used except that the chemical filter is filled with two-third of Chemsorb 1505 G3 (8×16) activated carbon from C*Chem (L Lafayette, Colo., A Division of Molecular Products Inc.) and one-third of calcium carbonate from Aldrich (Milwaukee, Wis.). In addition, a trapezoid-shape aluminum tube was installed between the head exchanger and the condensate trap. The condensates collected were analyzed for their PH values and aluminum contents (by use of ICP).

| | Without Filter | With Filter | | | | | |
|---|---|---|---|---|---|---|---|
| | | 0 hr. | 1.5 hr. | 2.5 hr. | 10 hr. | 20 hr | 30 hr. |
| PH | 2.2 | 4.5 | 5.4 | 5.7 | 5.2 | 5.4 | 5.5 |
| Aluminum, ppm | 64 | 7 | Not Detected | Not Detected | <8 | Not Detected | Not Detected |

From Examples 1 and 2, it is clear that the chemical filter can reduce acidity of the condensate. In Example 2, it was further demonstrated that the corrosion effect of the condensate was minimized.

What is claimed is:

1. A device to extend the useful life of a lubricant in an EGR equipped engine comprising:

a) a chemical filter placed in the EGR stream; and b) a heat exchanger/cooler placed in the upstream of the filter to reduce the temperature of said EGR stream and to increase the relative humidity the chemical filter being at a location in the EGR stream wherein the temperature of the EGR stream is such that the relative humidity of the EGR stream is greater than about 20% .

2. The device as in claim 1 wherein the chemical filter is placed in said EGR stream wherein the temperature of the EGR stream is such that the relative humidity of the EGR stream is greater than about 50%.

3. A method to extend the useful life of an EGR equipped internal combustion engine comprising:

a) placing a chemical filter in the EGR stream; and b) cooling the EGR stream using a heat exchanger/cooler thereby increasing the relative humidity of the EGR stream to greater than about 20%, the heat exchanger/cooler being placed upstream of the filter, whereby acidic components in the EGR stream are removed by the chemical filter before the EGR stream is introduced into the intake manifold.

4. A device to extend the useful life of a lubricant in an EGR equipped engine comprising:

a) an optional chemical filter placed in the EGR stream;

b) a chemical filter placed just before the intake manifold; and c) a heat exchanger/cooler placed in the upstream of the chemical filters to reduce the temperature of said EGR stream and to increase the relative humidity the chemical filter being at a location in the EGR stream wherein the temperature of the EGR stream is such that the relative humidity of the EGR stream is greater than about 20%.

5. The device as in claim 4 wherein the chemical filter is placed in locations in the EGR stream wherein the temperature of the EGR stream is such that the relative humidity is greater than about 50%.

6. A method to extend the useful life of an EGR equipped internal combustion engine comprising:

a) placing an optional chemical filter in the EGR stream;

b) placing a chemical filter just before the intake manifold at a location after the EGR stream is merged with intake air; and c) cooling the EGR stream using a heat exchanger/cooler thereby increasing the relative humidity of the EGR stream to greater than about 20%, the heat exchanger/cooler being placed upstream of the filters, whereby acidic components in the EGR stream are removed by the chemical filters before the EGR stream is introduced into the intake manifold.

7. A device to extend the useful life of a lubricant in an EGR equipped engine comprising:

a) a chemical filter placed in the EGR stream;

b) a heat exchanger/cooler placed in the upstream of the chemical filter to reduce the temperature of said EGR stream and to increase the relative humidity; and c) an oil filter capable of neutralizing acids in the engine lubricant the chemical filter being at a location in the EGR stream wherein the temperature of the EGR stream is such that the relative humidity of the EGR stream is greater than about 20%.

8. The device as in claim 7 wherein the chemical filter is placed in locations in the EGR stream wherein the temperature of the EGR stream is such that the relative humidity is greater than about 50%.

9. A method to extend the useful life of an EGR equipped internal combustion engine comprising:

a) placing a chemical filter in the EGR system;

b) cooling the EGR stream using a heat exchanger/cooler thereby increasing the relative humidity of the EGR stream to greater than 20%, the heat exchanger/cooler being placed upstream of the filter, whereby acidic components in the EGR stream are removed by the chemical filter before the EGR stream is introduced into the intake manifold; and c) placing an oil filter into the lubricating system capable of neutralizing acids in the engine lubricant.

10. A device to extend the useful life of a lubricant in an EGR equipped engine comprising:

a) an optional chemical filter placed in the EGR stream;

b) a chemical filter placed just before the intake manifold at a location after the EGR stream is merged with intake air;

c) a heat exchanger/cooler placed in the upstream of the chemical filters to reduce the temperature of said EGR stream and to increase the relative humidity; and d) an oil filter capable of neutralizing acids in the engine lubricant.

11. The device as in claim 10 wherein the chemical filter is placed in locations in the EGR stream wherein the temperature of the EGR stream is such that the relative humidity is greater than about 20%.

12. The device as in claim 10 wherein the chemical filter is placed in locations in the EGR stream wherein the temperature of the EGR stream is such that the relative humidity is greater than about 50%.

13. A method to extend the useful life of an EGR equipped internal combustion engine comprising:

a) placing an optional chemical filter in the EGR stream;

b) placing a chemical filter just before the intake manifold at a location after the EGR stream is merged with intake air;

c) cooling the EGR stream using a heat exchanger/cooler thereby increasing the relative humidity of the EGR stream, the heat exchanger/cooler being placed upstream of the filter, whereby acidic components in the EGR stream are removed by the chemical filter before the EGR stream is introduced into the intake manifold; and d) placing an oil filter into the lubrication system capable of neutralizing acids in the engine lubricant.

14. The device of claim 1, 4, 7 or 10 wherein the chemical filter is placed in locations in the EGR stream wherein the temperature of the EGR stream is only slightly above its dew point.

15. The method of claim 3, 6, 9 or 13 wherein the EGR stream is cooled using a heat exchanger/cooler to a temperature only slightly above its dew point.

* * * * *